US006098507A

United States Patent [19]

Lin

[11] Patent Number: 6,098,507

[45] **Date of Patent: *Aug. 8, 2000**

[54] UNIVERSAL SOCKET WRENCH

[76] Inventor: Chin Ho Lin, No. 20, Lane 458, Guang Der Road, Tai Ping City, Taichung Hsien, Taiwan

[ * ] Notice: This patent is subject to a terminal disclaimer.

[21] Appl. No.: 09/286,578

[22] Filed: Apr. 5, 1999

[51] Int. Cl.[7] ..... B25B 13/58

[52] U.S. Cl. ..... 81/185; 81/DIG. 11

[58] Field of Search ..... 811/185, DIG. 11, 811/442, 448, 124.4, 124.5

[56] References Cited

U.S. PATENT DOCUMENTS 3,349,655 10/1967 Locke ..... 81/185
3,698,267 10/1972 Denney ..... 81/185
5,460,064 10/1995 Zayat, Jr. ..... 81/185
5,622,090 4/1997 Marks ..... 81/185
5,806,385 9/1998 Schupp ..... 81/185
5,937,715 8/1999 Lin ..... 81/185

*Primary Examiner*—David A. Scherbel
*Assistant Examiner*—Joni B. Danganan
*Attorney, Agent, or Firm*—Charles E. Baxley, Esq.

[57] ABSTRACT

A universal socket wrench includes a housing having an inner bore and an outer opening of different sizes for forming a shoulder between the opening and the bore. The housing has a number of depressions communicating with the shoulder of the housing. A plate is engaged with the opening and the shoulder of the housing and has a number of projections engaged with the depressions of the housing for solidly securing the plate to the housing. A number of spring biased posts are slidably engaged with the plate for driving fasteners of various sizes.

2 Claims, 2 Drawing Sheets

UNIVERSAL SOCKET WRENCH

BACKGROUND OF THE INVENTION

1. Field of the Invention

The present invention relates to a socket, and more particularly to a universal socket wrench for engaging with and for driving fasteners of various sizes.

2. Description of the Prior Art

A typical socket is disclosed in U.S. Pat. No. 5,622,090 to Marks and comprises a housing having a chamber for slidably receiving a number of pins which are provided for engaging with fasteners of various sizes. A frame is secured in the housing and includes a number of arcuate hubs engaged into the notches of the housing. The pins are slidably engaged through the frame. However, the hubs of the frame will be easily disengaged from the notches of the housing such that the pins may not be stably retained in place by the frame.

The present invention has arisen to mitigate and/or obviate the afore-described disadvantages of the conventional socket wrenches.

SUMMARY OF THE INVENTION

The primary objective of the present invention is to provide a universal socket wrench which includes a number of hexagonal posts for solidly engaging with the fasteners of various sizes and which includes a plate that may be solidly retained in the housing.

In accordance with one aspect of the invention, there is provided a universal socket wrench comprising a housing including an inner portion having a bore formed therein and including an outer portion having an opening formed therein, the opening of the housing including a hexagonal cross section and including a size greater than that of the bore of the housing for forming a shoulder between the opening and the bore of the housing, the housing including a plurality of depressions formed therein and located above the shoulder and communicating with the shoulder of the housing, a plate received in the opening of the housing and including a peripheral portion having a plurality of projections extended therefrom for engaging with the depressions of the housing and for securing the plate to the housing, the peripheral portion of the plate being engaged with the shoulder of the housing for allowing the plate to be solidly secured in place in the housing, the plate including a plurality of apertures formed therein, a plurality of rods slidably engaged in the apertures of the plate, the rods each including a head for engaging with the plate and for preventing the rods from being disengaged from the plate, a plurality of posts secured to the rods and moved in concert with the rods, the posts each including a hexagonal cross section having six surfaces formed on an outer peripheral portion for engaging with fasteners to be rotated, and means for biasing the posts away from the plate. The posts are depressed inward of the housing against the biasing means for receiving the fasteners of various sizes when the fasteners are forced inward of the housing against the posts and the biasing means.

The plate includes a hexagonal cross section having six corners, the hexagonal opening of the housing includes six corners, the housing includes six curved slots formed in the corners of the hexagonal opening of the housing for receiving the corners of the plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
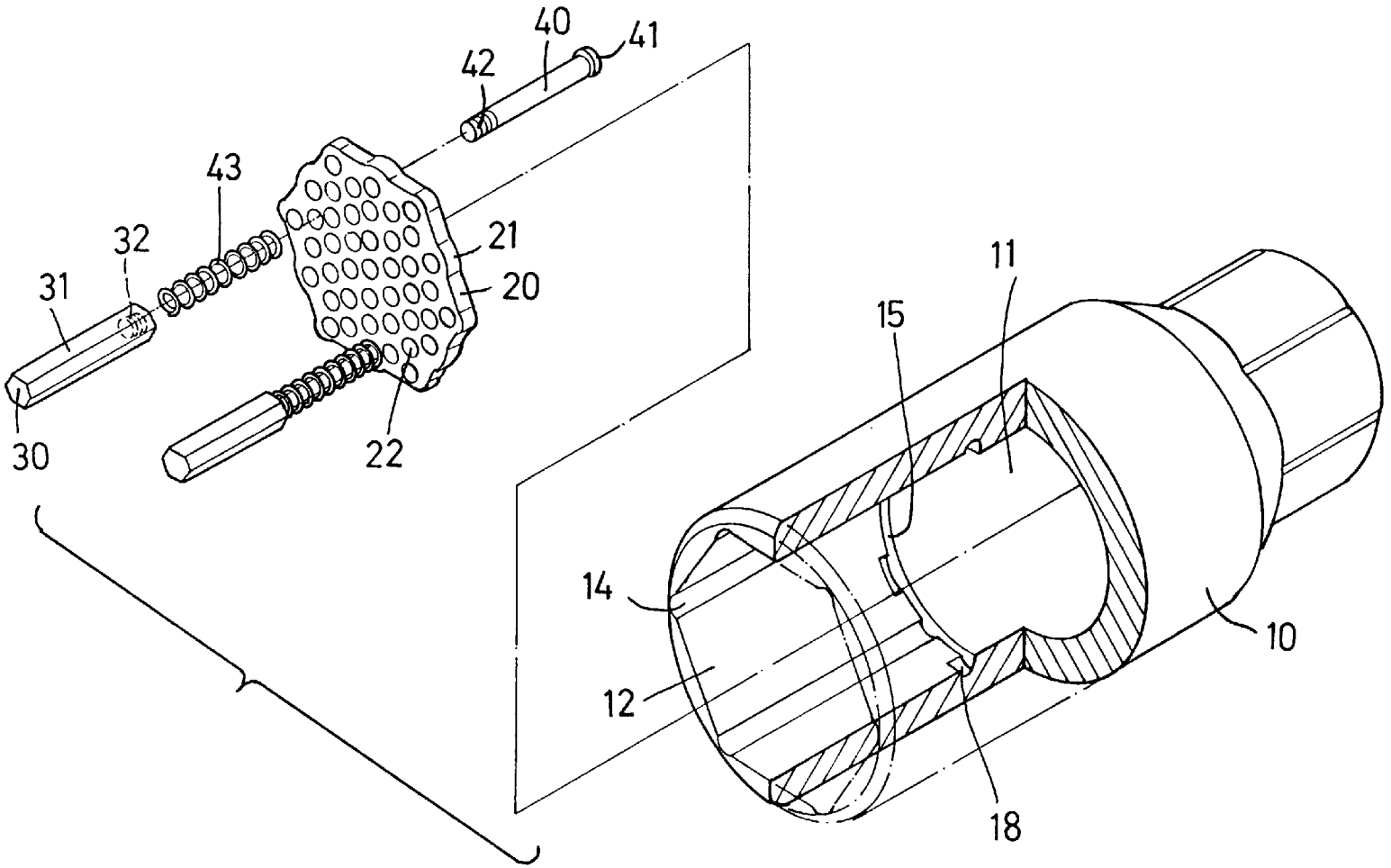
FIG. 1 is an exploded view of a universal socket wrench in accordance with the present invention.
Figure 2:
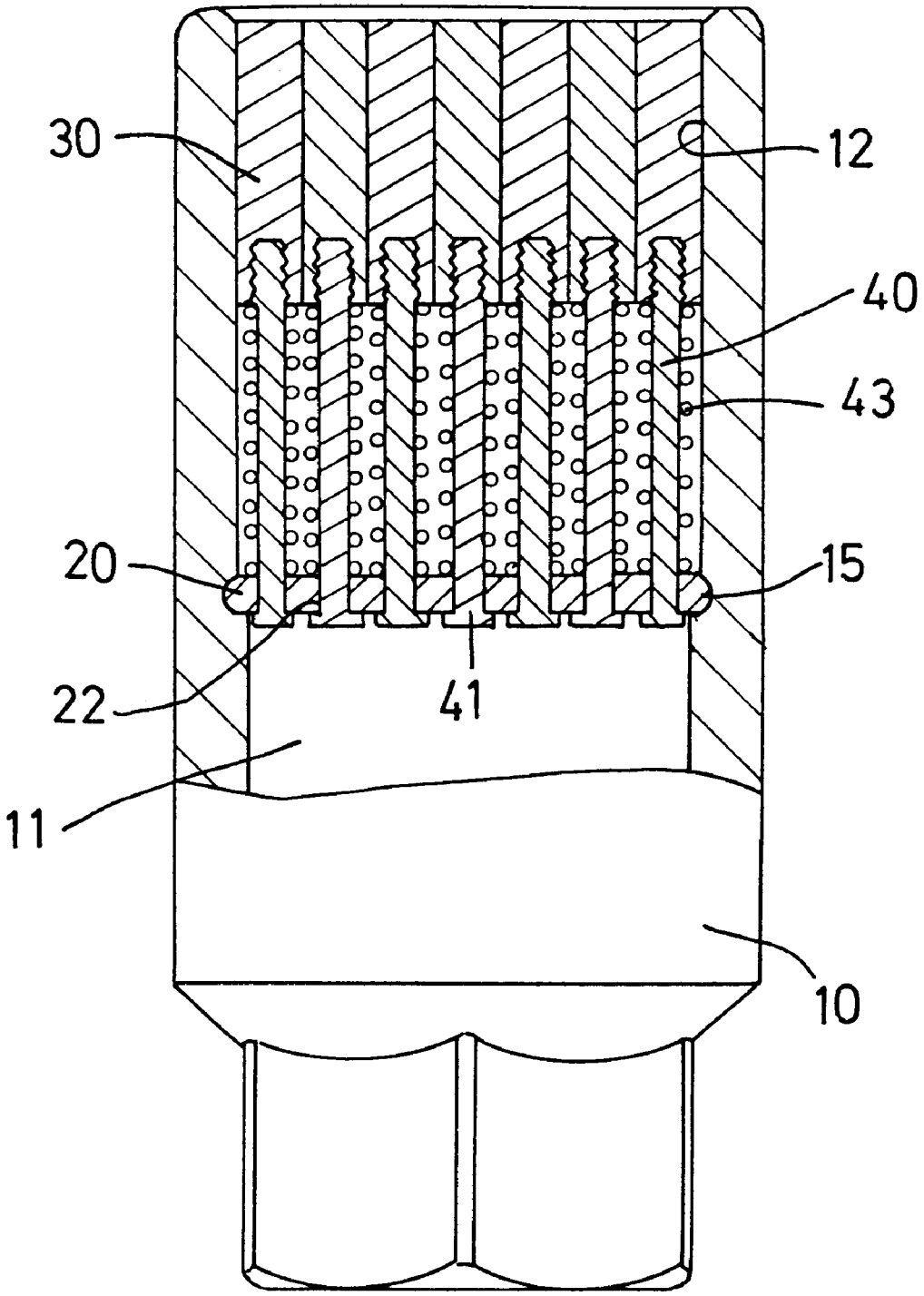
FIG. 2 is a partial cross sectional view of the universal socket wrench.

Referring to the drawings, and initially to FIG. 1, a universal socket wrench in accordance with the present invention comprises a housing 10 including a bore 11 formed in the inner portion thereof and including an opening 12 formed in the outer portion thereof and having a substantially hexagonal cross section. The housing 10 includes six curved slots 14 formed in the corners of the hexagonal opening 12 of the housing 10. As best shown in FIG. 2, the opening 12 of the housing 10 includes a size slightly greater than the bore 11 of the housing 10 such that an annular flat surface or a shoulder 15 is formed between the bore 11 and the opening 12 of the housing 10. The housing 10 includes a number of depressions 18 formed in the middle portion thereof and communicating with the shoulder 15 of the housing.

A plate 20 includes a hexagonal cross section having a number of projections 21 extended outward from the peripheral portion thereof for engaging with the depressions 18 and the curved slots of the housing 10 and for allowing the plate 20 to be secured in the middle portion of the housing 10 when the plate 20 is force-fitted into the housing 10. The peripheral portion of the plate 20 includes a bottom engaged with the shoulder 15 of the housing 10 for allowing the plate 20 to be further solidly retained in place. The plate 20 includes a number of apertures 22 formed therein for slidably receiving a number of rods 40. The rods 40 each includes a head 41 formed on one end for engaging with the plate 20 and each includes an outer thread 42 formed on the other end. A number of hexagonal posts 30 each includes six flat surfaces 31 formed on the outer peripheral portion and each includes an inner thread 32 formed in one end for engaging with the outer thread 42 of the rods 40 such that the posts 30 are solidly secured to and moved in concert with the rods 40. A number of springs 43 are engaged on the rods 40 and biased between the plate 20 and the posts 30 for biasing the posts 30 away from the plate 20 and for allowing the posts 30 to be depressed inward of the housing 10 against the springs 43. The heads 41 of the rods 40 may prevent the rods 40 from being disengaged from the plate 20.

The curved slots 14 of the housing 10 are preferably provided for receiving the corners of the plate 20 and the corners of some of the posts 30.

In operation, when the posts 30 are engaged with the fasteners of various sizes to be rotated, the posts 30 may be forced inward of the housing 10 against the springs 43 by the fasteners such that the fasteners may be stably retained in place by the posts 30.

It is to be noted that the provision of the annular flat surface or the shoulder 15 in the housing 10 may be used for supporting the peripheral portion of the plate 20 such that the plate 20 may further be solidly retained in place and will not be tilted relative to the housing 10.

Accordingly, the universal socket wrench in accordance with the present invention includes a number of hexagonal posts for solidly engaging with the fasteners of various sizes and includes a plate that may be solidly retained in the housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A universal socket wrench comprising:

a housing including an inner portion having a bore formed therein and including an outer portion having an opening formed therein, said opening of said housing including a hexagonal cross section and including a size greater than that of said bore of said housing for forming a shoulder between said opening and said bore of said housing, said housing including a plurality of depressions formed therein and located above said shoulder and communicating with said shoulder of said housing, a plate received in said opening of said housing and including a peripheral portion having a plurality of projections extended therefrom for engaging with said depressions of said housing and for securing said plate to said housing, said peripheral portion of said plate being engaged with said shoulder of said housing for allowing said plate to be solidly secured in place in said housing, said plate including a plurality of apertures formed therein, a plurality of rods slidably engaged in said apertures of said plate, said rods each including a head for engaging with said plate and for preventing said rods from being disengaged from said plate, a plurality of posts secured to said rods and moved in concert with said rods, said posts each including a hexagonal cross section having six surfaces formed on an outer peripheral portion for engaging with fasteners to be rotated, and means for biasing said posts away from said plate, said posts being depressed inward of said housing against said biasing means for receiving the fasteners of various sizes when the fasteners are forced inward of the housing against the posts and the biasing means.

2. The universal socket wrench according to claim 1, wherein said plate includes a hexagonal cross section having six corners, said hexagonal opening of said housing includes six corners, said housing includes six curved slots formed in said corners of said hexagonal opening of said housing for receiving said corners of said plate.

* * * * *